United States Patent [19]

McKechnie et al.

[11] Patent Number: 4,684,457

[45] Date of Patent: Aug. 4, 1987

[54] METHOD FOR DESALTING CRUDE OIL

[75] Inventors: Malcolm T. McKechnie, Egham; David G. Thompson, Richmond, both of England

[73] Assignee: The British Petroleum Company p.l.c., London, England

[21] Appl. No.: 806,474

[22] Filed: Dec. 9, 1985

[30] Foreign Application Priority Data

Dec. 20, 1984 [GB] United Kingdom ..... 8432278

[51] Int. Cl.[4] ..... C10G 33/04

[52] U.S. Cl. ..... 208/188; 208/187; 210/799

[58] Field of Search ..... 208/188, 187; 210/799

[56] References Cited

U.S. PATENT DOCUMENTS 3,417,013 12/1968 Roberts ..... 208/188
3,487,927 1/1970 Yahnke ..... 208/187
4,551,239 11/1985 Merchant ..... 208/188

FOREIGN PATENT DOCUMENTS 459489 12/1970 U.S.S.R. ..... 208/187

*Primary Examiner*—P. E. Konopka
*Attorney, Agent, or Firm*—Morgan & Finnegan

[57] ABSTRACT

The salt content of crude oil is reduced by washing it with at least 1% by volume of wash water of lower salinity than the water present in the crude oil and separating the resulting mixture of oil and water into a layer of crude oil of reduced salt content and a layer of saline water containing some oil. The latter is passed through a cross-flow membrane separator and the oil-free permeate is removed from the separator as effluent. The oil retentate is recycled from the separator to the washing stage and a quantity of lower salinity than the water associated initially with the crude oil is added to the washing stage. The quantity of added water corresponds at least to the volume of permeate removed from the cross-flow membrane separator.

Since the oil is recycled, the need for oil recovery plant for treating desalter effluent is removed.

6 Claims, 1 Drawing Figure

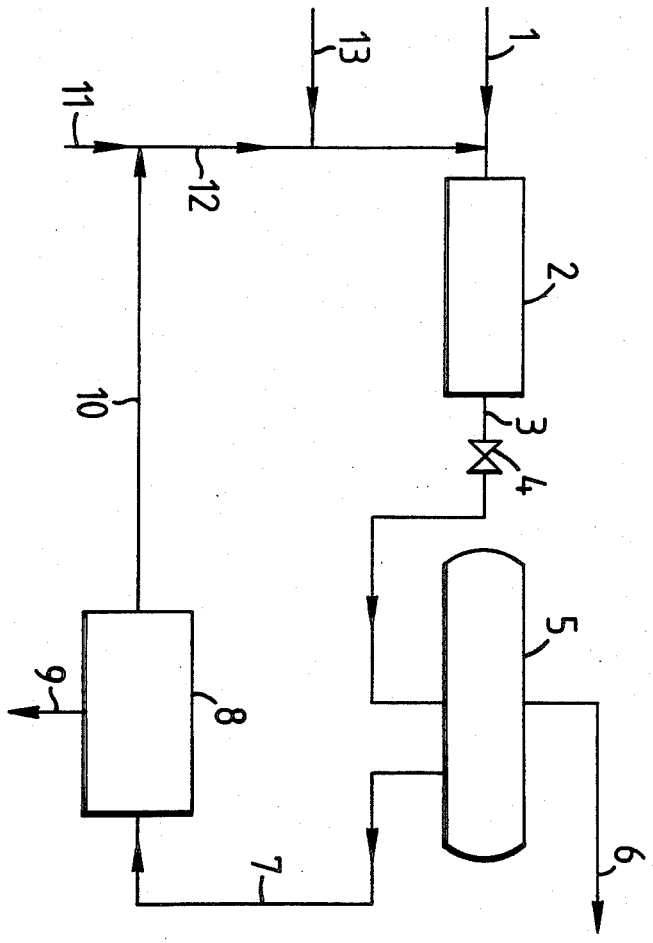
1
2
3
4
5
6
7
8
9
10
11
12
13

METHOD FOR DESALTING CRUDE OIL

This invention relates to a method for desalting crude petroleum in which problems associated with subsequent effluent treatment are overcome.

Crude oil is generally found in a reservoir in association with salt water and gas. The oil and gas occupy the upper part of the reservoir and below there may be a considerable volume of water, usually saline, which extends throughout the lower levels of the rock. As the reservoir becomes depleted, the oil/water interface in the reservoir rises and at some stage, water will be co-produced with the oil.

The mixture of water and oil is subjected to a high degree of turbulence as it flows through the well tubing and particularly as it passes through the well-head choke and other production facilities such as pumps. These actions form an emulsion in which water droplets are dispersed throughout the crude oil phase. The presence of indigenous surfactants in the crude oil also stabilises the emulsion by forming a rigid interfacial layer which prevents the water droplets from contacting and coalescing with one another.

Thus, following production, crude oil can contain dispersed water to a greater or lesser extent and this must be removed. The action of water removal is termed crude oil dehydration. Some emulsions may be broken down by heat alone but more often it is necessary to add a surface tension reducing chemical to achieve this end. Generally the application of heat and/or chemical is sufficient to reduce the water content, and more importantly the salt content, to an acceptable level but sometimes it is necessary to use electrostatic precipitation.

A dehydrated oil normally contains between 0.1 and 1.0% by vol. of water. However, if the salinity of the remaining water is high, the salt content of the crude oil will also be high, e.g. between 100–500 ptb (lbs salt per 1000 barrels of crude oil), even when such low quantities of water are present. This is undesirable because the presence of salt reduces the value of the crude oil, leads to the corrosion of pipelines and downstream distillation columns, fouling of heat exchangers and may poison catalysts used in downstream refining processes.

With most crude oils it is necessary to remove the salt from the crude oil by washing with fresh water or a low salinity aqueous phase, imparting a degree of mixing to ensure adequate contact between high salinity water in the crude and low salinity wash water and then carrying out the separation process by any of the means described above. This process is termed crude oil desalting.

The two processes of dehydration and desalting may both be carried out at the production location to give a crude oil of export quality, typically with less than 1% water and 20 ptb salt. Furthermore, an additional desalting process may be carried out after the crude oil is received at a refinery.

Normally in desalting a small amount (1–10% vol/vol) of fresh water or water of low salinity is added to the dehydrated crude oil. Adequate mixing of the wash water and crude oil to be desalted is required to induce good contact between saline droplets, salt crystals, if present, dispersed wash water droplets and emulsifier, if added. Consequently, an emulsion is produced which can be very stable with a low average droplet size. For a given crude oil and mixing intensity, the less wash water that is used, the lower the average droplet size and the more difficult the emulsion is to break. Washing with relatively large quantities of water results in the formation of a less stable emulsion, and consequently, less severe conditions are required for ultimate destabilisation (as disclosed in our copending European Patent Specification No. 0142278).

A problem associated with the use of relatively large quantities of fresh water or water of low salinity is its limited availability in many oil producing locations and at some refineries. However, this problem can be reduced considerably by recycling a portion of the separated wash water with some make-up.

Assuming optimum mixing, subsequent destabilisation of the emulsion can reduce the salt content to as low as 2 ptb (6 ppm). In order to desalt to such low levels, however, it is necessary to use conditions of high temperature, a chemical demulsifier and often electrostatic separation. Demulsifiers usually comprise blends of surface active chemicals, e.g., ethoxylated phenolic resins, in a carrier solvent.

The saline water which is removed from the system contains a significant proportion of oil, however, and is not suitable for discharge without further treatment.

We have now discovered that passing the saline water from the settling stage through a cross-flow membrane separator results in a permeate of relatively oil-free salt water suitable for discharge and a retenate of salt water of enhanced oil concentration.

The oily retentate or crossflow, is recycled to the washing stage and reinjected in the oil phase. Thus removal of oil from the oily crossflow is unnecessary. Providing the recycled water does not comprise more than 50% of the total wash water, the salt content of the combined recycle plus make up water will attain a constant value and not increase continuously.

Thus according to the present invention, there is provided a method for reducing the salt content of crude oil which method comprises washing crude oil containing salt water with at least 1% by volume of wash water of lower salinity than the water present in the crude oil (expressed as a percentage by volume of the crude oil), separating the resulting mixture of oil and water into a layer of crude oil of reduced salt content and a layer of saline water, passing the saline water through a cross-flow membrane separator, removing the permeate from the separator as effluent, recycling the retentate from the separator to the washing stage, and adding to washing stage a quantity of water of lower salinity than the water associated initially with the crude oil, the quantity of added water corresponding at least to the volume of permeate removed from the cross-flow membrane separator.

Preferably the added water is added directly to the recycle stream.

Cross-flow membrane separators are known and are described for example in The Chemical Engineer, June 1984, pages 10–14. In essence, a cross-flow membrane separator comprises a membrane surface which can be in various configurations such as flat sheets, pleated sheets, spiral wound or tubular and may incorporate means for promoting surface turbulence. The liquid stream to be treated is passed into the membrane unit and introduced parallel to the surface of the membrane. The component of the flow which passes through the membrane material is termed filtrate or permeate and the second component which flows tangentially across the membrane surface is known as the retentate, non-permeate or cross-flow component.

Unlike conventional equipment for treating oily water, a cross-flow membrane separator does not itself remove or adsorb the oil, but allows it to return to the desalter. This has the following advantages:

(a) Oil is not recovered from the membrane separator as oily slops and hence the need for oil recovery plant for treating desalter effluent, such as slop tanks is removed;

(b) The load on effluent treatment plant such as API separators is reduced as most of the oil is removed in a single stage by the cross-flow membrane separator;

Clean cross-flow membrane separators operate under conditions of high flux (e.g. 100 $l/min/m^2$ membrane) and low pressure drop (e.g. 1-3 bar).

This may deteriorate in operation as a result of build-up of deposits on their surface but can easily be regenerated by a simple backwash procedure.

Preferably the amount of wash water employed to treat the crude oil is in the range 1% to 50% by volume of the crude oil.

Preferably a demulsifier is added to the wash water before washing the crude oil to assist in breaking the water/crude oil emulsion.

There are significant advantages to be gained by using a water soluble demulsifier, particularly when the chemical is added to the wash water, because it is then dispersed together with the lower volume component, i.e. wash water, and more readily reaches the oil-water interface where the chemical is required to effect droplet coalescence.

To date, however, use of water soluble demulsifiers has been unattractive since they often give rise to stable, oily, separated water streams which require further treatment. Since, according to the present invention, the oily water stream is recycled, the problem of disposing of it does not arise.

If the demulsifier is water soluble, a large proportion will be recycled with the recycled oily water and only a top up will be required, thus reducing the chemical consumption. Furthermore, the possibility of demulsifier poisoning refinery catalysts is reduced when using a water-soluble as opposed to an oil-soluble demulsifier.

Suitable water soluble demulsifiers include silicone polyethers, petroleum sulphonates, ethylene oxide-propylene oxide block copolymers, polyglycol ethers and alkyl aryl ethoxylates, which are used with or without cosurfactants and/or solvents according to conventional demulsifier technology.

Suitable demulsifier concentrations are in the range 1 to 500 ppm, preferably 2 to 50 ppm.

Desalting may be carried out in the presence or absence of an electric field at a temperature in the range ambient to 150° C. depending on the temperature of the oil. At refineries, it is convenient to use desalters operating within the temperature range 100°-150° C.

The invention is illustrated with reference to the accompanying drawing, which is a schematic drawing of a desalting process.

Dehydrated crude oil (salt water content 0.2% by vol) is fed by line 1 to a heat exchanger 2. Wash water (5% vol/vol) containing a water soluble demulsifier is added through line 12 to the oil prior to heating.

The mixture of oil, salt water, wash water and demulsifier is passed through the heat exchanger 2, where its temperature is raised and then through line 3 and mixing valve 4 to a desalter 5.

Coalescence occurs in the desalter 5 and an aqueous layer containing some oil separates beneath the desalted crude oil which is taken off by line 6.

The aqueous layer is fed by line 7 to a flat-sheet cross-flow membrane separator 8 where 50% of the feed water permeates through the membrane and is discharged as relatively oil-free water through line 9.

The remaining 50% of the water containing the oil flows across the membrane surface and is recycled to the heat exchanger 2 by line 10.

The recycled oily wash water is joined by a make-up stream of fresh water 11 corresponding in quantity to that removed by line 9.

A water soluble demulsifier is added to the combined make-up and recycle line 12 by injector 13.

The invention is further illustrated with reference to the following Examples which describe the operation of the separator 8.

EXAMPLE 1

The filter was a nitrocellulose membrane with a pore rating of

1.2 μm. The cross-flow channels had a depth of 1 to 2 mm. The water to be treated contained both oily and solid matter.

Operating conditions were as follows:

| | |
|---|---|
| Temperature | 25°-30° C. |
| Pressure differential | 0.7 bar |
| Cross-flow stream | 1 l/min |
| Area of membrane used for filtration | 0.045 $m^2$ |
| Filtrate flux immediately before regeneration | 2 $l/min/m^2$ |
| Operating period | 2 hours |
| Regeneration procedure | backwash at 1.5 l/min for 10 secs every 10 mins |

The results obtained are set out in the following Table.

EXAMPLE 2

The filter was a polyvinylidene fluoride membrane with a pore rating of 0.45 pm.

The filtrate flux immediately before regeneration was 1.5 $l/min/pm^2$. In other respects, conditions were as in Example 1.

EXAMPLE 3

The filter was a polycarbonate membrane with a pore rating of 0.2 μm.

The filtrate flux immediately before regeneration was 1.4 $l/min/m^2$. In other respects, conditions were as in Example 1.

TABLE

| | Oil Content | | Solids Content | |
|---|---|---|---|---|
| Example | Feedstock mg/l | Filtrate mg/l | Feedstock mg/l | Filtrate mg/l |
| 1 | 70 | 16 | 19 | 1 |
| 2 | 160 | 21 | 10 | 1 |
| 3 | 120 | 19 | 28 | 5 |

We claim:

1. A method for reducing the salt content of crude oil which method comprises washing crude oil containing salt water with at least 1% by volume of wash water of lower salinity than the water present in the crude oil, expressed as a percentage by volume of the crude oil, separating the resulting mixture of oil and water into a layer of crude oil of reduced salt content and a layer of saline water, passing the saline water through a cross-flow membrane separator having a membrane surface, removing the permeate from the separator as effluent, recycling the retentate via a recycle stream from the separator to the washing stage, and adding to washing stage a quantity of water of lower salinity than the water associated initially with the crude oil, the quantity of added water corresponding at least to the volume of permeate removed from the cross-flow membrane separator.

2. A method according to claim 1 wherein the added water is added directly to the recycle stream.

3. A method according to claim 1 wherein the amount of wash water employed is in the range 1 to 50% by volume of the crude oil.

4. A method according to claim 1 wherein a demulsifier is added to the wash water before washing the crude oil.

5. A method according to claim 4 wherein the demulsifier is water soluble.

6. A method according to claim 4 wherein the concentration of the demulsifier is in the range 1 to 500 ppm.

* * * * *

UNITED STATES PATENT AND TRADEMARK OFFICE

CERTIFICATE OF CORRECTION

PATENT NO. : 4,684,457

DATED : August 4, 1987

INVENTOR(S) : Malcolm T. McKechnie and David G. Thompson

It is certified that error appears in the above-identified patent and that said Letters Patent is hereby corrected as shown below:

Column 4, line 42, change "pm" to --μm --;

line 44, change "pm" to --μm --.

Signed and Sealed this

First Day of December, 1987

*Attest:*

DONALD J. QUIGG

*Attesting Officer*

*Commissioner of Patents and Trademarks*